US009488396B2

(12) United States Patent
Kan et al.

(10) Patent No.: US 9,488,396 B2
(45) Date of Patent: Nov. 8, 2016

(54) AIR-CONDITIONING APPARATUS

(75) Inventors: Kentaro Kan, Tokyo (JP); Naomichi Tamura, Tokyo (JP); Kazuhisa Iwasaki, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 244 days.

(21) Appl. No.: 14/360,135

(22) PCT Filed: Jun. 13, 2012

(86) PCT No.: PCT/JP2012/003852

§ 371 (c)(1),
(2), (4) Date: May 22, 2014

(87) PCT Pub. No.: WO2013/099047

PCT Pub. Date: Jul. 4, 2013

(65) Prior Publication Data

US 2014/0331712 A1 Nov. 13, 2014

(30) Foreign Application Priority Data

Dec. 27, 2011 (JP) ..... 2011-286238

(51) Int. Cl.

*F25B 43/02* (2006.01)
*F25B 31/00* (2006.01)
*F25B 13/00* (2006.01)

(52) U.S. Cl.

CPC ..... *F25B 43/02* (2013.01); *F25B 31/004* (2013.01); *F25B 13/00* (2013.01); *F25B 2313/023* (2013.01); *F25B 2313/025* (2013.01); *F25B2400/075* (2013.01); *F25B 2600/025* (2013.01); *F25B 2700/03* (2013.01)

(58) Field of Classification Search

CPC ..... F25B 43/02; F25B 31/004; F25B 13/00; F25B 2700/03; F25B 2313/025; F25B 2400/075; F25B 2600/025; F25B 2313/023
USPC ..... 62/470
See application file for complete search history.

(56) References Cited

U.S. PATENT DOCUMENTS 3,316,731 A * 5/1967 Quick ..... F25B 5/00 137/601.13
5,522,233 A * 6/1996 Nares ..... F04B 39/04 417/228
5,634,345 A * 6/1997 Alsenz ..... F04B 39/0207 184/7.4

(Continued)

FOREIGN PATENT DOCUMENTS

JP 2004-205175 A 7/2004
JP 2006-118826 A 5/2006

(Continued)

OTHER PUBLICATIONS

Extended European Search Report issued Oct. 29, 2015 in the corresponding EP application No. 12862177.8.

(Continued)

*Primary Examiner* — Mohammad M Ali
(74) *Attorney, Agent, or Firm* — Posz Law Group, PLC

(57) ABSTRACT

An air-conditioning apparatus capable of storing a surplus of refrigerating machine oil and returning a necessary amount of the refrigerating machine oil to a compressor as required. In an air-conditioning apparatus, a controller determines the amount of refrigerating machine oil that is present in a compressor by measuring power of the compressor and controls opening and closing of a solenoid valve on the basis of the measurement results.

11 Claims, 4 Drawing Sheets

(56) References Cited

U.S. PATENT DOCUMENTS

| | | | | |
|---|---|---|---|---|
| 5,638,689 | A * | 6/1997 | Scaringe | F25B 45/00 62/125 |
| 5,673,570 | A * | 10/1997 | Sada | F04B 39/0207 62/193 |
| 5,685,331 | A * | 11/1997 | Westermeyer | F16K 31/18 137/426 |
| 6,263,694 | B1 * | 7/2001 | Boyko | F25B 31/004 62/195 |
| 8,959,947 | B2 * | 2/2015 | Zhai | F25B 31/004 417/228 |
| 2001/0027664 | A1 * | 10/2001 | Ross | F25B 40/04 62/513 |
| 2006/0196220 | A1 * | 9/2006 | Westermeyer | F25B 43/02 62/470 |
| 2006/0196221 | A1 * | 9/2006 | Westermeyer | F25B 43/02 62/470 |
| 2009/0277213 | A1 * | 11/2009 | Sakitani | F25B 9/06 62/470 |

FOREIGN PATENT DOCUMENTS

| | | | |
|---|---|---|---|
| JP | 2007-101127 | A | 4/2007 |
| JP | 2008-139001 | A | 6/2008 |
| JP | 4274235 | B2 | 3/2009 |
| JP | 2010-255859 | A | 11/2010 |

OTHER PUBLICATIONS

Office Action issued Oct. 27, 2015 in the corresponding JP application No. 2013-551176 (with English translation).

International Search Report of the International Searching Authority mailed Sep. 11, 2012 for the corresponding international application No. PCT/JP2012/003852 (with English translation).

Office Action issued Jul. 1, 2015 in the corresponding Chinese patent application No. 201280064904.X (English translation attached).

Office Action mailed Mar. 17, 2015 issued in corresponding JP patent application No. 2013-551176 (and English translation).

* cited by examiner

AIR-CONDITIONING APPARATUS

CROSS REFERENCE TO RELATED APPLICATIONS

The present disclosure is a U.S national stage application of PCT/JP2012/003852 filed on Jun. 13, 2012 and is based on Japanese patent application No. 2011-286238 filed on Dec. 27, 2011, the contents of which are incorporated herein by reference.

TECHNICAL FIELD

The present invention relates to an air-conditioning apparatus that includes a compressor as one of element devices of a refrigeration cycle.

BACKGROUND ART

In the related art, there is a technique for collecting refrigerating machine oil that is discharged along with a refrigerant from a compressor in an air-conditioning apparatus that includes the compressor as one of element devices of a refrigeration cycle. In general, the amount of refrigerating machine oil to be sealed is uniformly set on the basis of an air-conditioning apparatus that includes the longest refrigerant pipe among air-conditioning apparatus in which refrigerating machine oil is expected to be sealed. In addition, an amount of refrigerating machine oil including an estimated amount of refrigerating machine oil to be deposited on a refrigerant pipe and the like is usually sealed in advance. Therefore, in practice, operations of air-conditioning apparatus are performed in a state where the amount of refrigerating machine oil is large. In particular, in the case of an air-conditioning apparatus that includes a refrigerant pipe that is short in length, there will be a large surplus of refrigerating machine oil.

Therefore, "a technology for calculating a surplus amount of refrigerating machine oil contained in a compressor on the basis of the length of a refrigerant pipe of a refrigerant circuit and opening an on-off valve of a connection pipe at predetermined time intervals in accordance with the surplus amount of the oil" has been proposed (see, for example, Patent Literature 1).

CITATION LIST

Patent Literature

Patent Literature 1: Japanese Unexamined Patent Application Publication No. 2008-139001 (claim 4, p. 9, and the like)

SUMMARY OF INVENTION

Technical Problem

The technology described in Patent Literature 1 is a technology for returning refrigerating machine oil to a compressor at predetermined time intervals in accordance with the surplus amount of refrigerating machine oil that is calculated. However, in the technology described in Patent Literature 1, the opening and closing interval of an on-off valve is set in advance on the basis of the length of a refrigerant pipe, and thus, an excessive amount of refrigerating machine oil may sometimes be returned to a compressor depending on the outside air conditions or operational state. In this case, the operational efficiency of the compressor deteriorates, and also the amount of oil to be melted into a refrigerant increases. As a result, the amount of refrigerating machine oil that flows out from the compressor and that is to be deposited on a refrigerant pipe and the like increases, and this causes deterioration of the performance of a heat exchanger. In addition, an operation on-site such as inputting the length of a refrigerant pipe is necessary, and there has been a risk that inputting an incorrect length of a refrigerant pipe results in a lack of refrigerating machine oil which in turn results in compressor failure.

The present invention has been made to solve such problems described above, and it is an object of the present invention to provide an air-conditioning apparatus capable of storing a surplus of refrigerating machine oil and returning a necessary amount of the refrigerating machine oil to a compressor as required.

Solution to Problem

An air-conditioning apparatus according to the present invention includes a compressor that compresses and discharges a refrigerant, a condenser that exchanges heat between a refrigerant that is discharged from the compressor and a heat medium, an expansion valve that depressurizes a refrigerant that has flowed out from the condenser, an evaporator that exchanges heat between a refrigerant that is depressurized by the expansion valve and a heat medium, an oil separator that is disposed on a discharge side of the compressor and that separates refrigerating machine oil from a refrigerant that is discharged by the compressor, an oil reservoir that is disposed on a downstream side of the oil separator and that stores refrigerating machine oil that is separated by the oil separator, a first connection pipe that connects a bottom portion of the oil reservoir and a suction side of the compressor, a second connection pipe that connects a portion of the oil reservoir that is above a portion to which the first connection pipe is connected and the suction side of the compressor, a solenoid valve that is provided to the first connection pipe and that opens and closes the first connection pipe, and a controller that controls opening and closing of the solenoid valve on the basis of an amount of refrigerating machine oil that is present in the compressor.

Advantageous Effects of Invention

According to an air-conditioning apparatus according to the present invention, since the air-conditioning apparatus has a configuration in which a surplus of refrigerating machine oil is stored in an oil reservoir, and a necessary amount of the refrigerating machine oil is returned to a compressor as required by controlling a solenoid valve so as to be open, the operational efficiency of the compressor does not deteriorate, the surplus of the refrigerating machine oil can be prevented from depositing within a refrigerant pipe, and deterioration of the performance of a heat exchanger will not be caused.

DESCRIPTION OF EMBODIMENTS

Figure 1:
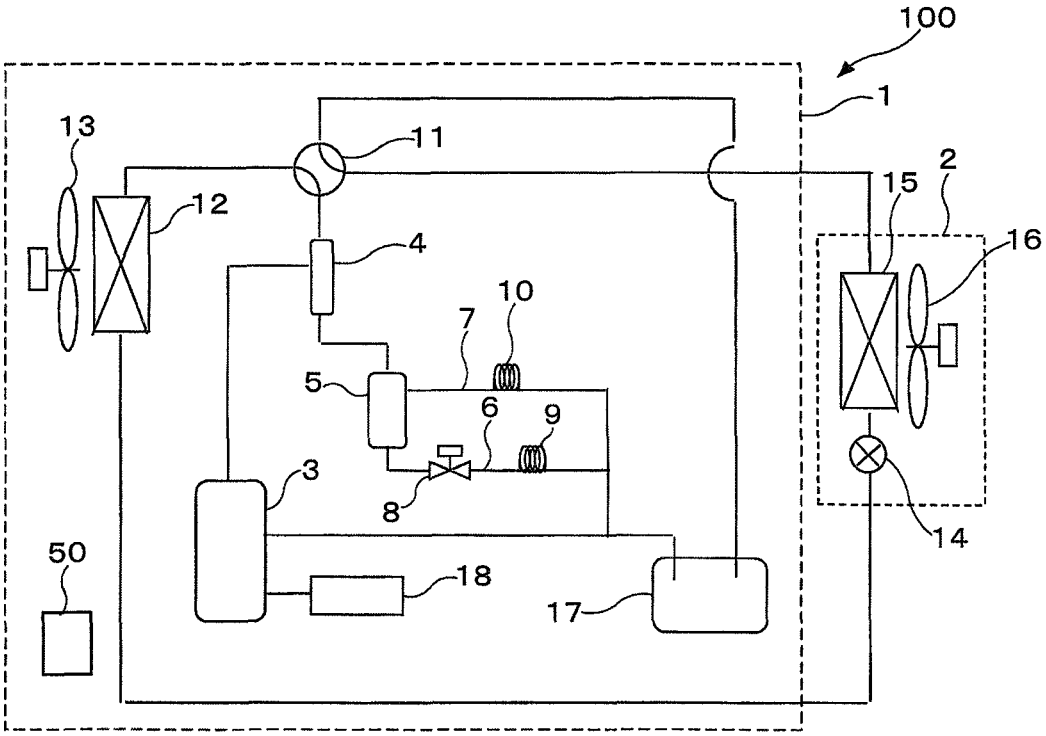
FIG. 1 is a circuit configuration diagram schematically illustrating an exemplary refrigerant circuit configuration of an air-conditioning apparatus according to Embodiment 1 of the present invention.

Embodiments of the present invention will be described below with reference to the drawings. Note that, in the drawings including FIG. 1 that will be referred to in the following, the relationship between component members with respect to their sizes may sometimes be different from the actual relationship between the component members with respect to their sizes. In addition, in the drawings including FIG. 1, which will be referred to in the following, components denoted by the same reference numerals are the same or correspond to each other, and this is common through the full text of the description. Furthermore, forms of the components described in the full text of the description are merely examples, and the present invention is not limited to these descriptions.

Embodiment 1

FIG. 1 is a circuit configuration diagram schematically illustrating an exemplary refrigerant circuit configuration of an air-conditioning apparatus 100 according to Embodiment 1 of the present invention. The configuration and operation of the air-conditioning apparatus 100 according to Embodiment 1 will be described with reference to FIG. 1.

As illustrated in FIG. 1, the air-conditioning apparatus 100 includes an outdoor unit 1 and an indoor unit 2. The outdoor unit 1 and the indoor unit 2 are configured to communicate with each other by being connected to each other by a refrigerant pipe. Note that although the case where the number of the outdoor units 1 is one has been described as an example in FIG. 1, the number of the outdoor units 1 to be installed is not particularly limited and may be two or greater. In addition, although the case where the number of the indoor units 2 is one has been described as an example in FIG. 1, the number of the indoor units 2 to be installed is not particularly limited and may be two or greater.

The outdoor unit 1 has a function of providing heating energy or cooling energy to the indoor unit 2. A compressor 3, an oil separator 4, a four-way valve 11, an outdoor heat exchanger 12, an accumulator 17, an oil reservoir 5, a solenoid valve 8, first depressurizing means 9, second depressurizing means 10, an blower device 13, an electric power meter 18, and a controller 50 are mounted in the outdoor unit 1. Among these, the compressor 3, the oil separator 4, the four-way valve 11, the outdoor heat exchanger 12, the accumulator 17, the oil reservoir 5, the solenoid valve 8, the first depressurizing means 9, the second depressurizing means 10 are connected by pipes.

The compressor 3 compresses a refrigerant into a high temperature, high pressure refrigerant. The oil separator 4 is disposed on a discharge side of the compressor 3 and separates refrigerating machine oil, which is discharged along with a refrigerant from the compressor 3, from the refrigerant. The four-way valve 11 is disposed on a downstream side of a refrigerant flow path of the oil separator 4 and is controlled in accordance with operations (a cooling operation and a heating operation) of the air-conditioning apparatus 100 in such a manner as to perform switching of a flow of a refrigerant. The outdoor heat exchanger 12 exchanges heat between the refrigerant that has been discharged from the compressor 3 or a refrigerant that is to be drawn into the compressor 3 and air that is supplied from the blower device 13. The accumulator 17 is disposed on a suction side of the compressor 3 and stores a surplus amount of refrigerant from a refrigerant that circulates in a refrigeration cycle.

The oil reservoir 5 is disposed on a downstream side of an oil flow path of the oil separator 4 and stores refrigerating machine oil that has been separated in the oil separator 4. Other than a connection pipe of the oil separator 4, two pipes (a connection pipe 6 and a connection pipe 7) are connected to the oil reservoir 5. The solenoid valve 8 is provided to the connection pipe 6 and opens and closes the connection pipe 6 by being controlled. The first depressurizing means 9 is provided for the connection pipe 6 on a downstream side of the solenoid valve 8, and the first depressurizing means 9 depressurizes refrigerating machine oil that flows through the connection pipe 6 and adjusts the flow rate, that is, an oil returning amount. The second depressurizing means 10 is provided for the connection pipe 7, and the second depressurizing means 10 depressurizes refrigerating machine oil that flows through the connection pipe 7 and adjusts the flow rate, that is, an oil returning amount. Note that each of the first depressurizing means 9 and the second depressurizing means 10 may be formed of a capillary tube or the like. Although the case where the solenoid valve 8 and the first depressurizing means 9 are arranged in series has been described herein, the solenoid valve 8 and the first depressurizing means 9 may be arranged in parallel by using the first depressurizing means 9 that has a sufficiently large flow path resistance, that is, that has a sufficiently small oil returning amount.

The connection pipe 6 is configured to connect a bottom portion of the oil reservoir 5 and a suction pipe of the compressor 3. In other words, refrigerating machine oil that is stored in the oil reservoir 5 is configured to return to the compressor 3 via the connection pipe 6. The connection pipe 7 is configured to connect a top portion of the oil reservoir 5 (a portion positioned above a portion to which the connection pipe 6 is connected) and the suction pipe of the compressor 3. The connection pipe 7 has a function of serving as an overflow pipe that is used when refrigerating machine oil that cannot be stored in the oil reservoir 5 flows out from the oil reservoir 5. The position where the connection pipe 7 is connected to the oil reservoir 5 is set such that the internal capacity of the oil reservoir 5 from the bottom of the oil reservoir 5 to the position where the connection pipe 7 is connected is smaller than the internal capacity of the compressor 3. The blower device 13 is disposed in the vicinity of the outdoor heat exchanger 12 in the outdoor unit 1 and supplies air to the outdoor heat exchanger 12. The electric power meter 18 is connected to the compressor 3 and measures the power of the compressor 3.

The controller 50 integrally controls the overall system of the air-conditioning apparatus 100. More specifically, the controller 50 controls the drive frequency of the compressor 3, the rotation speeds of the blower device 13 and an blower device 16, which will be described later, switching of the four-way valve 11, opening and closing of the solenoid valve 8, the opening degree of an expansion valve 14, which will be described later, and the like. In other words, the controller 50 controls actuators (driving components such as the compressor 3, the four-way valve 11, the blower device 13, the solenoid valve 8, the expansion valve 14, and the blower device 16) on the basis of detected information detected by various types of detection elements (not illustrated) and an instruction from a remote control.

The indoor unit 2 has a function of heating or cooling an air-conditioned space such as a space inside a room by using heating energy or cooling energy that is supplied from the outdoor unit 1. The expansion valve 14, an indoor heat exchanger 15, and the blower device 16 are mounted in the indoor unit 2. Among these, the expansion valve 14 and the indoor heat exchanger 15 are connected by pipes. In other words, in the air-conditioning apparatus 100, the compressor 3, the outdoor heat exchanger 12, the expansion valve 14, and the indoor heat exchanger 15 are connected by pipes, so that a refrigeration cycle is formed.

The expansion valve 14 depressurizes and expands a refrigerant that circulates in the refrigeration cycle, and the expansion valve 14 is formed of a member whose opening degree is variably controllable such as, for example, an electronic expansion valve. The indoor heat exchanger 15 exchanges heat between a refrigerant that has been discharged from the compressor 3 or a refrigerant that has been depressurized in the expansion valve 14 and air that is supplied from the blower device 16. The blower device 16 is disposed in the vicinity of the indoor heat exchanger 15 in the indoor unit 2 and supplies air to the indoor heat exchanger 15.

Air-conditioning operation of the air-conditioning apparatus 100 will now be described along with a flow of a refrigerant.

First, a flow of a refrigerant in a cooling operation that is performed by the air-conditioning apparatus 100 will be described. A high temperature, high pressure gas refrigerant that has been compressed in the compressor 3 flows into the outdoor heat exchanger 12 via the four-way valve 11, becomes a high-pressure liquid refrigerant by rejecting heat through heat exchange between the refrigerant and outdoor air that is supplied from the blower device 13, and flows out from the outdoor heat exchanger 12. The high-pressure liquid refrigerant, which has flowed out from the outdoor heat exchanger 12, flows out from the outdoor unit 1 and flows into the indoor unit 2. The high-pressure liquid refrigerant, which has flowed in the indoor unit 2, flows into the expansion valve 14 and is depressurized in such a manner as to become a low-pressure two-phase refrigerant.

The low-pressure two-phase refrigerant, which has flowed out from the expansion valve 14, flows into the indoor heat exchanger 15, becomes a low-pressure gas refrigerant by evaporating through heat exchange between the refrigerant and indoor air that is supplied from the blower device 16, and flows out from the indoor heat exchanger 15. The low-pressure gas refrigerant, which has flowed out from the indoor heat exchanger 15, flows out from the indoor unit 2 and flows into the outdoor unit 1. The low-pressure gas refrigerant, which has flowed in the outdoor unit 1, eventually returns to the compressor 3 via the four-way valve 11 and the accumulator 17. In a cooling operation, the outdoor heat exchanger 12 serves as a condenser (a radiator), and the indoor heat exchanger 15 serves as an evaporator.

Next, a flow of a refrigerant in a heating operation that is performed by the air-conditioning apparatus 100 will be described. A high temperature, high pressure gas refrigerant that has been compressed in the compressor 3 flows into the indoor heat exchanger 15 via the four-way valve 11, becomes a high-pressure liquid refrigerant by rejecting heat through heat exchange between the refrigerant and indoor air that is supplied from the blower device 16, and flows out from the indoor heat exchanger 15. The high-pressure liquid refrigerant, which has flowed out from the indoor heat exchanger 15, flows into the expansion valve 14 and is depressurized in such a manner as to be in a low-pressure two-phase state.

The low-pressure two-phase refrigerant, which has flowed out from the expansion valve 14, flows out from the indoor unit 2 and flows into the outdoor unit 1. The low-pressure two-phase refrigerant, which has flowed in the outdoor unit 1, flows into the outdoor heat exchanger 12. The low-pressure two-phase refrigerant, which has flowed in the outdoor heat exchanger 12, becomes a low-pressure gas refrigerant by evaporating through heat exchange between the refrigerant and outdoor air that is supplied from the blower device 13 and flows out from the outdoor heat exchanger 12. The low-pressure gas refrigerant, which has flowed out from the outdoor heat exchanger 12, eventually returns to the compressor 3 via the four-way valve 11 and the accumulator 17. In a heating operation, the outdoor heat exchanger 12 serves as an evaporator, and the indoor heat exchanger 15 serves as a condenser (a radiator).

Figure 2:
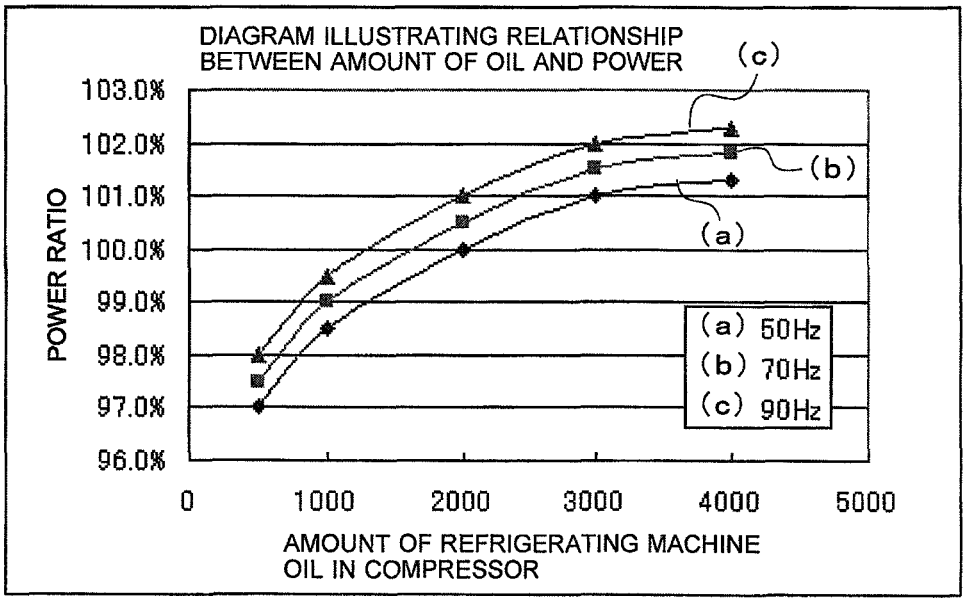
FIG. 2 is a diagram illustrating a relationship between an amount of refrigerating machine oil in a compressor and power of the compressor.

FIG. 2 is a diagram illustrating a relationship between an amount of refrigerating machine oil in the compressor 3 and power of the compressor 3. The relationship between an amount of the refrigerating machine oil in the compressor 3 and power of the compressor 3 will be described with reference to FIG. 2. In FIG. 2, the vertical axis represents power ratio (%), and the horizontal axis represents amount of refrigerating machine oil (ml). In FIG. 2, (a) represents the case where the drive frequency of the compressor 3 is 50 Hz, (b) represents the case where the drive frequency of the compressor 3 is 70 Hz, and (c) represents the case where the drive frequency of the compressor 3 is 90 Hz.

It is understood from FIG. 2 that, as the amount of the refrigerating machine oil in the compressor 3 increases, the power ratio of the compressor 3 increases when the drive frequency of the compressor 3 is any of the above values. In other words, by measuring the power of the compressor 3, the amount of the refrigerating machine oil that is present in the compressor 3 can be determined from the drive frequency of the compressor 3 at the time of the measurement. Therefore, in the air-conditioning apparatus 100, the electric power meter 18 is connected to the compressor 3, the power of the compressor 3 is measured, and the amount of the refrigerating machine oil that is present in the compressor 3 is determined in real time. The controller 50 is configured to determine, on the basis of a relationship that is stored in advance such as that illustrated in FIG. 2, the amount of refrigerating machine oil from the power that is measured.

It is preferable to use the suction pressure of a refrigerant at a time when the refrigerant is drawn into the compressor 3 or the discharge pressure of a refrigerant at a time when the refrigerant is discharged from the compressor 3 as one of parameters for determining the amount of refrigerating machine oil that is present in the compressor 3. In addition, it is preferable to use the quality of a refrigerant at a time when the refrigerant is discharged from the compressor 3 as one of the parameters for determining the amount of refrigerating machine oil that is present in the compressor 3. In this case, a pressure sensor and a temperature sensor may be provided on the suction side and the discharge side of the compressor 3 in such a manner that information obtained by these sensors is to be input to the controller 50.

Figure 3:
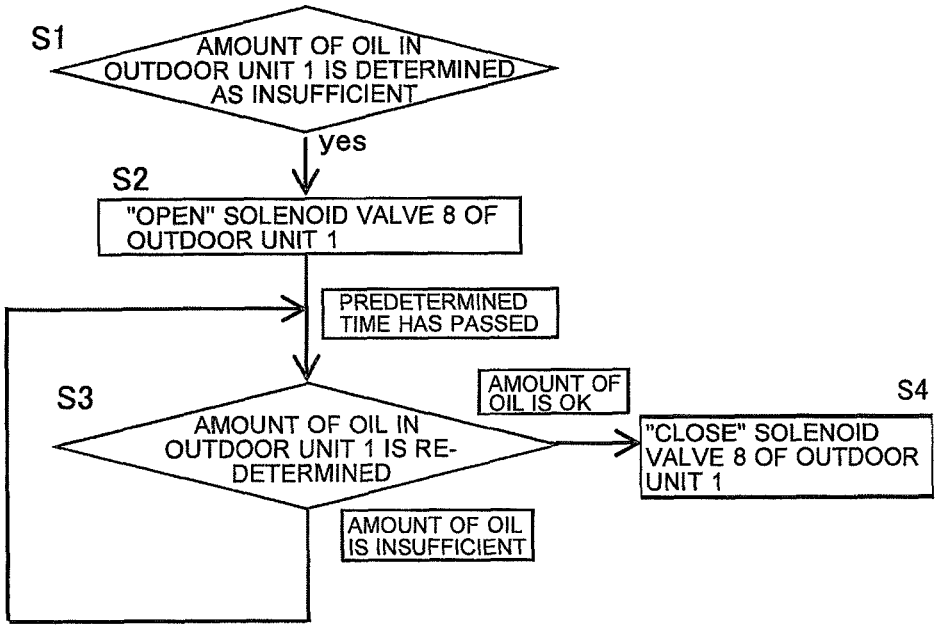
FIG. 3 is a flowchart illustrating a process flow of an oil returning operation that is performed by the air-conditioning apparatus according to Embodiment 1 of the present invention.

FIG. 3 is a flowchart illustrating a process flow of an oil returning operation that is performed by the air-conditioning apparatus 100. The oil returning operation that is performed by the air-conditioning apparatus 100 will be described with reference to FIG. 3.

The controller 50 determines the amount of refrigerating machine oil in the compressor 3 on the basis of information from the electric power meter 18 (step S1). The determination of the amount of the refrigerating machine oil is performed by comparing power that is input from the electric power meter 18 and a predetermined value. The predetermined value is set on the basis of a diagram such as that illustrated in FIG. 2. In this case, the suction pressure of a refrigerant, the discharge pressure of a refrigerant, and the quality of a refrigerant may be used for determining the amount of the refrigerating machine oil. When it is determined that the amount of the refrigerating machine oil in the compressor 3 is insufficient (step S1; yes), the controller 50 controls the solenoid valve 8 so as to be open (step S2). When the solenoid valve 8 is controlled to be open, the oil reservoir 5 and the suction pipe of the compressor 3 communicate with each other via the connection pipe 6. Therefore, refrigerating machine oil that is stored in the oil reservoir 5 is caused to return to the compressor 3 via the connection pipe 6.

The controller 50 redetermines the amount of the refrigerating machine oil in the compressor 3 after a certain time (e.g., about one minute) has passed (step S3). When it is determined that the amount of the refrigerating machine oil in the compressor 3 is not insufficient (step S3; AMOUNT OF OIL IS OK), the controller 50 controls the solenoid valve 8 so as to be closed (step S4). In this state, when the amount of oil stored in the oil reservoir 5 is small, a refrigerant mainly flows through the connection pipe 7 via the second depressurizing means 10 and returns to the compressor 3. When the amount of the oil that is stored is large, a refrigerant having high concentration flows through the connection pipe 7 via the second depressurizing means 10 and returns to the compressor 3. On the other hand, when it is determined that the amount of the refrigerating machine oil in the compressor 3 is still insufficient (step S3; AMOUNT OF OIL IS INSUFFICIENT), the controller 50 repeats step S3 in which the amount of the refrigerating machine oil in the compressor 3 is determined until it is determined that the amount of the refrigerating machine oil is not insufficient.

As described above, the air-conditioning apparatus 100 has the configuration in which a surplus of refrigerating machine oil is stored in the oil reservoir 5, and a necessary amount of the refrigerating machine oil is returned to the compressor 3 as required by controlling the solenoid valve 8 so as to be open, and thus, the operational efficiency of the compressor 3 does not deteriorate, the surplus of the refrigerating machine oil can be prevented from depositing within a refrigerant pipe, and deterioration of the performance of a heat exchanger will not be caused. In addition, according to the air-conditioning apparatus 100, an installation operator is not required to input the length of a refrigerant pipe on-site, and the labor and time required for installation work can be reduced.

Embodiment 2

Figure 4:
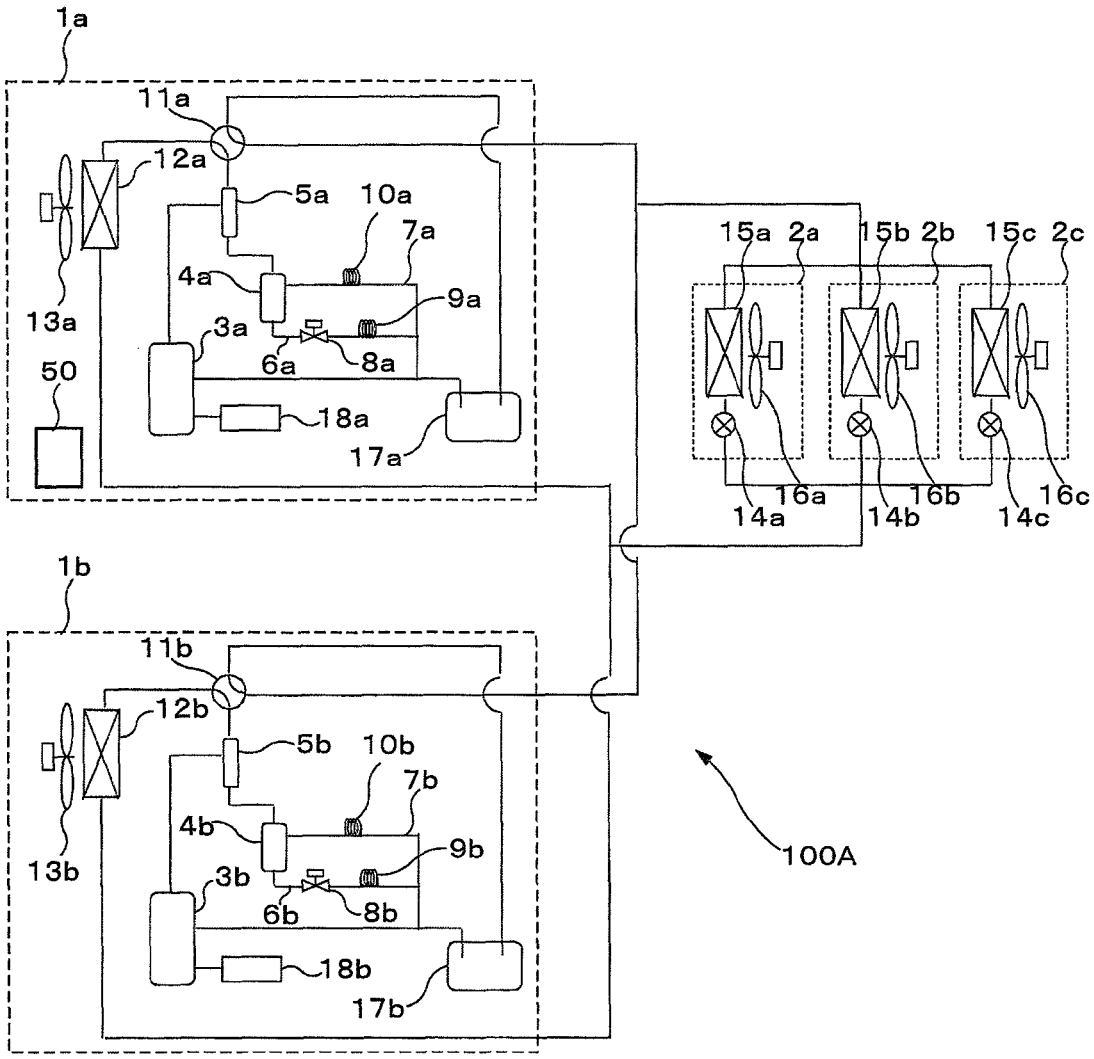
FIG. 4 is a circuit configuration diagram schematically illustrating an exemplary refrigerant circuit configuration of an air-conditioning apparatus according to Embodiment 2 of the present invention.

FIG. 4 is a circuit configuration diagram schematically illustrating an exemplary refrigerant circuit configuration of an air-conditioning apparatus 100A according to Embodiment 2 of the present invention. The configuration and operation of the air-conditioning apparatus 100A according to Embodiment 2 will be described with reference to FIG. 4. Note that, in Embodiment 2, differences from Embodiment 1 will be mainly described. Portions that are the same as those of Embodiment 1 are denoted by the same reference numerals, and descriptions thereof will be omitted.

In the air-conditioning apparatus 100A, differences from the air-conditioning apparatus 100 according to Embodiment 1 are that two outdoor units 1 are connected in parallel, and that three indoor units 2 are connected in parallel. The reference letters "a" and "b" are given to the two outdoor units 1. In accordance with this, the reference letter "a" is given to each of units that are mounted in the outdoor unit 1*a*, and the reference letter "b" is given to each of units that are mounted in the outdoor unit 1*b*. In addition, the reference letters "a", "b", and "c" are given to the three indoor units 2. In accordance with this, the reference letter "a" is given to each of units that are mounted in the indoor unit 2*a*, the reference letter "b" is given to each of units that are mounted in the indoor unit 2*b*, and the reference letter "c" is given to each of units that are mounted in the indoor unit 2*c*.

The basic configurations of the outdoor unit 1*a* and the outdoor unit 1*b* are similar to that of the outdoor unit 1 that has been described in Embodiment 1. The outdoor unit 1*a* and the outdoor unit 1*b* are arranged in parallel by connecting a four-way valve 11*a* with a four-way valve 11*b* and connecting an outdoor heat exchanger 12*a* with an outdoor heat exchanger 12*b*, respectively, by refrigerant pipes. The basic configurations of the indoor unit 2*a*, the indoor unit 2*b*, and the indoor unit 2*c* are also similar to that of the indoor unit 2 that has been described in Embodiment 1. The indoor unit 2*a*, the indoor unit 2*b*, and the indoor unit 2*c* are arranged in parallel by connecting an indoor heat exchanger 15*a*, an indoor heat exchanger 15*b*, and an indoor heat exchanger 15*c* by refrigerant pipes, and connecting an expansion valve 14*a*, an expansion valve 14*b*, and an expansion valve 14*c* by refrigerant pipes.

In other words, in the air-conditioning apparatus 100A, the refrigerant pipe that connects the outdoor unit 1 and the indoor unit 2 of the air-conditioning apparatus 100 according to Embodiment 1 is branched, and a plurality of the outdoor units 1 (the outdoor unit 1*a* and the outdoor unit 1*b*) and a plurality of the indoor units 2 (the indoor unit 2*a*, the indoor unit 2*b*, and the indoor unit 2*c*) are connected, so that the air-conditioning apparatus 100A is formed. Note that, although the case where a controller 50 is mounted only in the outdoor unit 1*a* has been described as an example in FIG. 4, the controller 50 may be mounted only in the outdoor unit 1*b*, or the controller 50 may be mounted in each of the outdoor unit 1*a* and the outdoor unit 1*b*. In the case where the controller 50 is mounted in each of the outdoor unit 1*a* and the outdoor unit 1*b*, it is preferable that the controllers 50 can communicate with each other by a wireless or wired connection.

Figure 5:
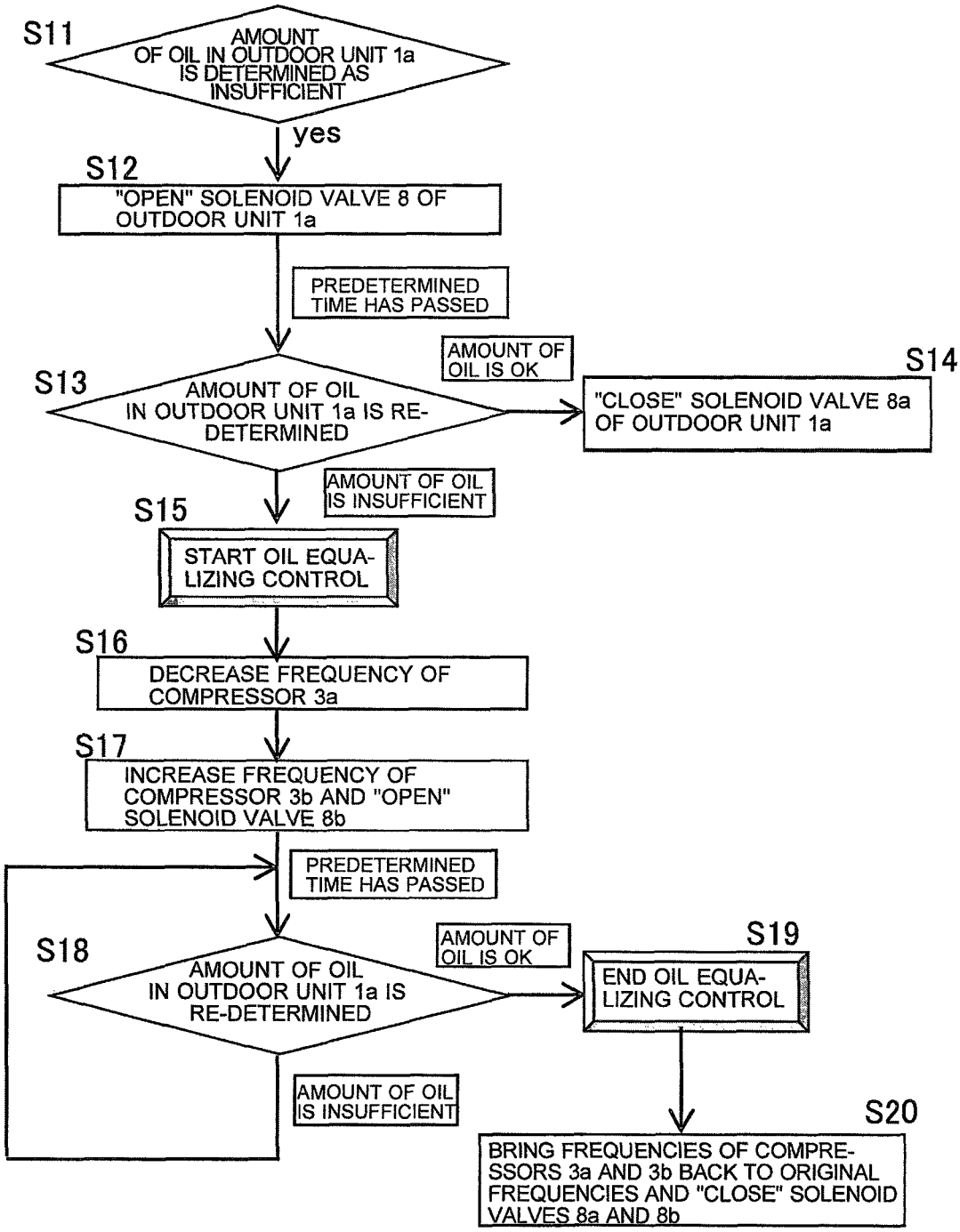
FIG. 5 is a flowchart illustrating a process flow of an oil returning operation that is performed by the air-conditioning apparatus according to Embodiment 2 of the present invention.

FIG. 5 is a flowchart illustrating a process flow of an oil returning operation that is performed by the air-conditioning apparatus 100A. The oil returning operation that is performed by the air-conditioning apparatus 100A will be described with reference to FIG. 5. The air-conditioning apparatus 100A is configured to perform oil equalizing control for uniformly distributing refrigerating machine oil to the outdoor unit la and the outdoor unit 1*b* in addition to the oil returning operation of the air-conditioning apparatus 100 according to Embodiment 1.

The controller 50 determines the amount of refrigerating machine oil in a compressor 3*a* on the basis of information from an electric power meter 18*a* of the outdoor unit 1*a* (step S11). In this case, the suction pressure of a refrigerant, the discharge pressure of a refrigerant, and the quality of a refrigerant may be used for determining the amount of the refrigerating machine oil. When it is determined that the amount of the refrigerating machine oil in the compressor 3*a* of the outdoor unit la is insufficient (step S11; yes), the controller 50 controls a solenoid valve 8*a* of the outdoor unit la so as to be open (step S12). The solenoid valve 8*a* is controlled to be open, so that an oil reservoir 5*a* and a suction pipe of the compressor 3*a* communicate with each other via a connection pipe 6*a*. Therefore, refrigerating machine oil that is stored in the oil reservoir 5*a* is caused to return to the compressor 3*a* via the connection pipe 6*a*.

The controller 50 redetermines the amount of the refrigerating machine oil in the compressor 3*a* of the outdoor unit 1*a* after a certain time (e.g., about one minute) has passed (step S13). When it is determined that the amount of the refrigerating machine oil in the compressor 3*a* is not insufficient (step S13; AMOUNT OF OIL IS OK), the controller 50 controls the solenoid valve 8*a* so as to be closed (step S14). On the other hand, when it is determined that the amount of the refrigerating machine oil in the compressor 3*a* of the outdoor unit 1*a* is still insufficient (step S13; AMOUNT OF OIL IS INSUFFICIENT), the controller 50 starts the oil equalizing control for the outdoor unit 1*a* and the outdoor unit 1*b* (step S15).

The controller 50 brings down (decreases) the frequency of the compressor 3*a* of the outdoor unit 1*a* (step S16), After that, the controller 50 brings up (increases) the frequency of a compressor 3*b* of the outdoor unit 1*b* and controls a solenoid valve 8*b* so as to be open (step S17). The controller 50 redetermines the amount of the refrigerating machine oil in the compressor 3*a* of the outdoor unit 1*a* after a certain time (e.g., about one minute) has passed (step S18). When it is determined that the amount of the refrigerating machine oil in the compressor 3*a* is not insufficient (step S18; AMOUNT OF OIL IS OK), the controller 50 controls the solenoid valve 8*a* so as to be closed (step S19). Then, the controller 50 brings the frequencies of the compressor 3*a* of the outdoor unit 1*a* and the compressor 3*b* of the outdoor unit 1*b* back to the original frequencies and controls the solenoid valve 8*a* and the solenoid valve 8*b* so as to be closed (step S20).

On the other hand, when it is determined that the amount of the refrigerating machine oil in the compressor 3*a* of the outdoor unit 1*a* is still insufficient (step S18; AMOUNT OF OIL IS INSUFFICIENT), the controller 50 repeats step S18 in which the amount of the refrigerating machine oil in the compressor 3*a* of the outdoor unit 1*a* is determined unless it is determined that the amount of the refrigerating machine oil is not insufficient. As described above, in the air-conditioning apparatus 100A, variations in the amount of the refrigerating machine oil between the outdoor unit 1*a* and the outdoor unit 1*b* is eliminated, and equalization of the refrigerating machine oil is performed. Note that, although the case where determination of the amount of refrigerating machine oil is performed in the outdoor unit 1*a* has been described as an example in FIG. 5, it is obvious that determination of the amount of refrigerating machine oil may be performed in the outdoor unit 1*b*.

As described above, the air-conditioning apparatus 100A has the configuration in which a surplus of refrigerating machine oil is stored in the oil reservoirs 5 (the oil reservoir 5*a* and an oil reservoir 5*b*), and a necessary amount of refrigerating machine oil is returned to the compressors 3 (the compressor 3*a* and the compressor 3*b*) as required by controlling the solenoid valves 8 (the solenoid valve 8*a* and the solenoid valve 8*b*) so as to be open, and thus, the operational efficiency of the compressors 3 (the compressor 3*a* and the compressor 3*b*) does not deteriorate, he surplus of the refrigerating machine oil can be prevented from depositing within a refrigerant pipe, and deterioration of the performance of a heat exchanger will not be caused. In addition, the air-conditioning apparatus 100A is configured to perform oil equalizing control, and thus, refrigerating machine oil will not be unevenly distributed to one of the outdoor units. Therefore, in all of the outdoor units, refrigerating machine oil will not become insufficient or excessive. In addition, according to the air-conditioning apparatus 100A, an installation operator is not required to input the length of a refrigerant pipe on-site, and the labor and time required for installation work can be reduced.

Note that the type of a refrigerant that is to be used in the air-conditioning apparatus according to Embodiments 1 and 2 is not particularly limited, and for example, any of natural refrigerants such as carbon dioxide ($CO_2$), hydrocarbons, and helium, chlorine-free alternative refrigerants such as HFC410A, HFC407C, and HFC404A, and fluorocarbon refrigerants such as R22 and R134a that have been used in existing products may be used. In addition, although the cases where the outdoor heat exchanger 12 and the indoor heat exchanger 15 perform heat exchange between a refrigerant and air have been described as examples in Embodiments 1 and 2, the outdoor heat exchanger 12 and the indoor heat exchanger 15 may perform heat exchange between heat media such as, for example water and brine other than a refrigerant and air.

REFERENCE SIGNS LIST

1 outdoor unit 1*a* outdoor unit 1*b* outdoor unit 2 indoor unit 2*a* indoor unit 2*b* indoor unit 2*c* indoor unit 3 compressor 3*a* compressor 3*b* compressor 4 oil separator 4*a* oil separator 4*b* oil separator 5 oil reservoir 5*a* oil reservoir 5*b* oil reservoir 6 connection pipe (first connection pipe) 6*a* connection pipe (first connection pipe) 6*b* connection pipe (first connection pipe) 7 connection pipe (second connection pipe) 7*a* connection pipe (second connection pipe) 7*b* connection pipe (second connection pipe) 8 solenoid valve 8*a* solenoid valve 8*b* solenoid valve 9 first depressurizing means 9*a* first depressurizing means 9*b* first depressurizing means 10 second depressurizing means 10*a* second depressurizing means 10*b* second depressurizing means 11 four-way valve 11*a* four-way valve 11*b* four-way valve 12 outdoor heat exchanger 12*a* outdoor heat exchanger 12*b* outdoor heat exchanger 13 blower device 13*a* blower device 13*b* blower device 14 expansion valve 14*a* expansion valve 14*b* expansion valve 14*c* expansion valve 15 indoor heat exchanger 15*a* indoor heat exchanger 15*b* indoor heat exchanger 15*c* indoor heat exchanger 16 blower device 16*a* blower device 16*b* blower device 16*c* blower device 17 accumulator 17*a* accumulator 17*b* accumulator 18 electric power meter 18*a* electric power meter 18*b* electric power meter 50 controller 100 air-conditioning apparatus 100A air-conditioning apparatus

The invention claimed is:

1. An air-conditioning apparatus comprising:

a compressor that compresses and discharges a refrigerant;

a condenser that exchanges heat between a refrigerant that is discharged from the compressor and a heat medium;

an expansion valve that depressurizes a refrigerant that has flowed out from the condenser;

an evaporator that exchanges heat between a refrigerant that is depressurized by the expansion valve and a heat medium;

an oil separator that is disposed on a discharge side of the compressor and that separates refrigerating machine oil from the refrigerant that is discharged by the compressor;

an oil reservoir that is disposed on a downstream side of the oil separator and that stores refrigerating machine oil that is separated by the oil separator, a first connection pipe that connects a bottom portion of the oil reservoir and a suction side of the compressor;

a second connection pipe that connects a portion of the oil reservoir that is more above than a portion thereof to which the first connection pipe is connected and the suction side of the compressor;

a solenoid valve that is provided to the first connection pipe and that opens and closes the first connection pipe; and a controller that controls opening and closing of the solenoid valve on the basis of an amount of refrigerating machine oil that is present in the compressor, wherein the controller uses, for determining the amount of refrigerating machine oil that is present in the compressor, at least one of power of the compressor, a drive frequency of the compressor, and a quality of a refrigerant that is discharged from the compressor.

2. The air-conditioning apparatus of claim 1, wherein the controller controls the solenoid valve so as to be open and supplies refrigerating machine oil that is stored in the oil reservoir to the compressor when it is determined that an amount of refrigerating machine oil that is present in the compressor is insufficient.

3. The air-conditioning apparatus of claim 1, wherein a position where the second connection pipe is connected to the oil reservoir is set such that an internal capacity of the oil reservoir from the bottom of the oil reservoir to the position where the second connection pipe is connected is smaller than an internal capacity of the compressor.

4. The air-conditioning apparatus of claim 1, wherein the controller uses, for determining an amount of refrigerating machine oil that is present in the compressor, at least another one of a discharge pressure of a refrigerant that is discharged from the compressor and a suction pressure of a refrigerant that is drawn into the compressor.

5. The air-conditioning apparatus of claim 1, wherein a depressurizing unit is provided for each of the first connection pipe and the second connection pipe, and wherein an accumulator is disposed further upstream than the suction side of the compressor to which the first connection pipe and the second connection pipe are connected.

6. An air-conditioning apparatus comprising:

a compressor that compresses and discharges a refrigerant, a condenser that exchanges heat between a refrigerant that is discharged from the compressor and a heat medium;

an expansion valve that depressurizes a refrigerant that has flowed out from the condenser;

an evaporator that exchanges heat between a refrigerant that is depressurized by the expansion valve and a heat medium;

an oil separator that is disposed on a discharge side of the compressor and that separates refrigerating machine oil from the refrigerant that is discharged by the compressor;

an oil reservoir that is disposed on a downstream side of the oil separator and that stores refrigerating machine oil that is separated by the oil separator, a first connection pipe that connects a bottom portion of the oil reservoir and a suction side of the compressor;

a second connection pipe that connects a portion of the oil reservoir that is more above than a portion thereof to which the first connection pipe is connected and the suction side of the compressor;

a solenoid valve that is provided to the first connection pipe and that opens and closes the first connection pipe; and a controller that controls opening and closing of the solenoid valve on the basis of an amount of refrigerating machine oil that is present in the compressor, wherein the compressor, an outdoor heat exchanger that serves as the condenser or the evaporator, the oil separator, the oil reservoir, the first connection pipe, the second connection pipe, and the solenoid valve are mounted in outdoor units, wherein the expansion valve and an indoor heat exchanger that serves as the evaporator or the condenser are mounted in indoor units, wherein a plurality of the indoor units are connected to a plurality of the outdoor units, respectively, wherein, when it is determined that an amount of refrigerating machine oil that is present in the compressor that is mounted in a specified outdoor unit of the outdoor units is insufficient, the controller decreases a drive frequency of the compressor, increases a drive frequency of the compressor that is mounted in another outdoor unit of the outdoor units, and equalizes an amount of refrigerating machine oil between the outdoor units by controlling the solenoid valve that is mounted in the another outdoor unit of the outdoor units so as to be open.

7. An air-conditioning apparatus comprising:

a compressor arranged and configured to compress and discharge a refrigerant;

a condenser arranged and configured to exchange heat between a refrigerant being discharged from the compressor and a heat medium;

an expansion valve arranged and configured to depressurize a refrigerant that has flowed out from the condenser;

an evaporator arranged and configured to exchange heat between a refrigerant that is depressurized by the expansion valve and a heat medium;

an oil separator disposed on a discharge side of the compressor and configured to separates refrigerating machine oil from the refrigerant being discharged by the compressor;

an oil reservoir disposed on a downstream side of the oil separator and configured to store separated refrigerating, machine oil after being separated by the oil separator, a first connection pipe connecting a suction side of the compressor and a bottom portion of the oil reservoir;

a second connection pipe connecting the suction side of the compressor and the oil reservoir at a connecting position above the bottom portion of the oil reservoir to which the first connection pipe is connected;

a solenoid valve provided within the first connection pipe and configured to open and close the first connection pipe; and a controller configured to control opening and closing of the solenoid valve on the basis of an amount of refrigerating machine oil that is present in the compressor, wherein the controller is configured to determine the amount of refrigerating machine oil that is present in the compressor based on at least one parameter selected from the group consisting of power of the compressor, a drive frequency of the compressor, and a quality of a refrigerant that is discharged from the compressor.

8. The air-conditioning apparatus of claim 7, wherein the controller is configured to open the solenoid for supplying refrigerating machine oil stored in the oil reservoir to the compressor after determining that the amount of refrigerating machine oil present in the compressor is insufficient.

9. The air-conditioning apparatus of claim 7, wherein the connecting position of the second connection pipe on the oil reservoir is set at a position where an internal capacity of the oil reservoir from the bottom of the oil reservoir to the connecting position is smaller than an internal capacity of the compressor.

10. The air-conditioning apparatus of claim 7, wherein the controller is configured to determine the amount of refrigerating machine oil that is present in the compressor based on at least another parameter selected from the group consisting of a discharge pressure of a refrigerant that is discharged from the compressor and a suction pressure of a refrigerant that is drawn into the compressor.

11. The air-conditioning apparatus of claim 7, wherein a depressurizing unit is provided for each of the first connection pipe and the second connection pipe, and wherein an accumulator is disposed further upstream than the suction side of the compressor to which the first connection pipe and the second connection pipe are connected.

* * * * *